United States Patent [19]

Price

[11] Patent Number: 5,072,847

[45] Date of Patent: Dec. 17, 1991

[54] PAINT CAN POUR LIP

[76] Inventor: Frank C. Price, 13812 Sand-Hurst Pl., Santa Ana, Calif. 92705-2744

[21] Appl. No.: 474,549

[22] Filed: Feb. 2, 1990

[51] Int. Cl.[5] ..... B65D 25/48

[52] U.S. Cl. ..... 220/733; 220/4.03

[58] Field of Search ..... 220/90, 90.2, 90.4, 220/85 SP, 4 A; 222/569, 570

[56] References Cited

U.S. PATENT DOCUMENTS

| | | | |
|---|---|---|---|
| 2,075,721 | 3/1937 | Hommel | 220/90 |
| 2,331,971 | 10/1943 | Gramp | 222/570 |
| 2,552,702 | 5/1951 | Woolfolk | 220/4 A |
| 2,636,650 | 4/1953 | Marrier | 222/570 |
| 2,722,347 | 11/1955 | Henke | 220/90 |
| 2,812,886 | 11/1957 | Weinstein | 220/90 |
| 2,904,208 | 9/1959 | Woolfolk | 220/4 A |
| 2,960,257 | 11/1960 | Sasse | 220/90 |
| 3,469,735 | 9/1969 | Burt | 220/90 |
| 4,125,210 | 11/1978 | Embree | 220/90 |
| 4,911,319 | 3/1990 | DeJean | 220/90 |

*Primary Examiner*—Gary E. Elkins
*Assistant Examiner*—S. Castellano

[57] ABSTRACT

Flexible, extruded strips and molded, curved pieces are used as pressed-in fillers for the edge grooves in an opened can of paint. This acts as a cover for the groove where the lid seals. The result is that an opened can of paint may be poured-from without the lid seal area becoming fouled by paint. A pour lip is also provided to preclude paint running down the can after the pouring.

2 Claims, 2 Drawing Sheets

PAINT CAN POUR LIP

BACKGROUND

1. Technical Field

The present invention applies to the problems encountered with the lid seal after the pouring of contents from a container, especially paint from a container of paint. The container is usually metal. The lid is mostly flat with a deep underside lip near its circumference which acts as a male insert into a groove shape around the top perimeter of the container. There actually are two concentric grooves around the top of the container. The lid seal is formed in the inner groove. The lid seal is created by tapping the lid lip down into the larger groove. In the pouring of contents from the container, the container groove (or grooves) for its lid becomes inundated with the contents. Liquid usually runs down the side of the container after the pouring. The liquid left in the groove is removed only with difficulty. Liquids, especially paint, which solidify upon contact with air will coat the groove and prevent the lid's being resealed air-tight. Prying the dried residue out of the groove results in chunks of residue contaminating the contents of the container.

2. Description of the Related Art

The only known previous solution to this is a technique used by some people of hammering holes with a nail into the groove so that the liquid drains back into the container after the pouring. Still, the groove does not drain completely.

SUMMARY OF THE INVENTION

The present invention is a filler/cover for the perimeter groove area of a paint can where the lid seal is made. The filler/cover also has a lip to enhance dripless pouring from the container. The filler/cover in one form is an easily-bendable strip that is curved and pressed down, around and into the groove. In another form it is a cast piece of plastic or rubber in the shape of an arc of a circle which is pressed over the grooves and the entire container upper edge. After paint is poured from the container the filler is readily peeled out of the groove and is discarded or is wiped off, ready for re-use, a clean groove then remaining. An important feature of the invention is that the filler/cover can be produced by mass production methods for plastic or rubber goods.

The bendable strip form of the invention might be less costly to produce and package. It consists of two press-together pieces, one a channel, the other a plug, in cross section. The plug-like piece nests into the channel of the other. Each piece has a radiating flange having deep-toothed edges to allow bending of the overall piece to fit the curvature of the container groove, and yet, the two sets of teeth, one in each piece, overlap to become the pour spout. This same approach with two nested strips can also be carried out as two side-by-side strips, each filling up approximately one-half of the container groove.

In another version of the invention the container groove for the lid seal is kept dry of the contents of the container upon pouring by having the device shaped as an inverted "U" in cross section which actually is pressed onto the container edge along the arc of the circumference of the container where the pouring is to occur, and becomes a cover for the groove over which the contents flow as they pour from the container.

DETAILED DESCRIPTION

Figure 1:
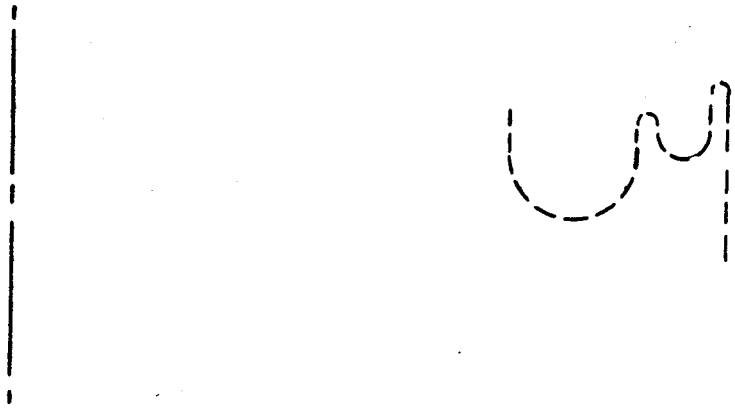
FIG. 1 shows in phantom lines the outline of a typical container groove for the lid seal which is where any of the articles of this invention are installed.
Figure 3:
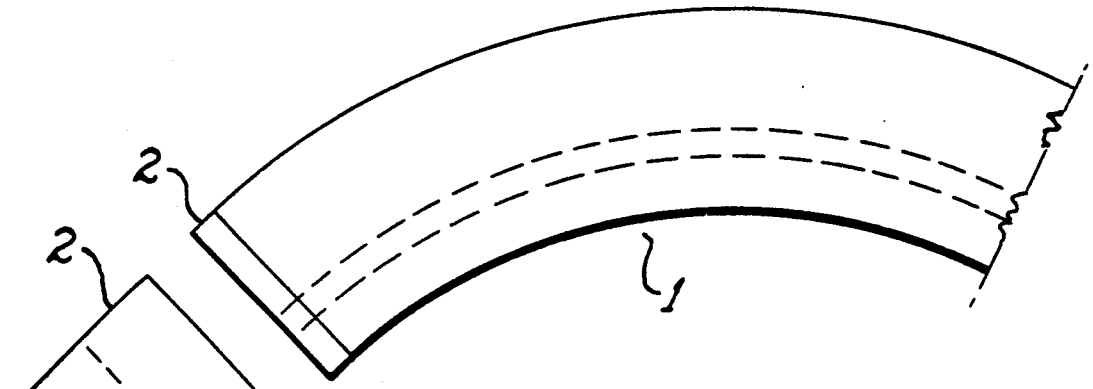
FIG. 3 is a plan view of FIG. 2 showing the piece bent into an arc.
Figure 2:
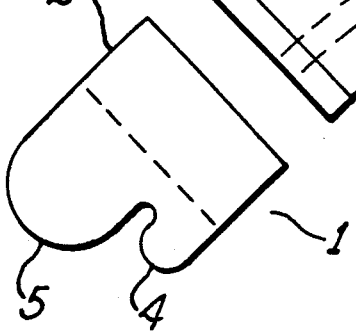
FIG. 2 is the cross section of a groove filler piece which can be manufactured as a continuous strip, then cut into pieces for use.

Starting with the phantom outline of the cross section of the rim of a container with its grove for the lid seal, FIG. 1, one can readily see how a strip of flexible material with the cross section 1 shown in FIG. 2 might be bent into the arc of the container groove and then pressed into the groove to protect the groove from intrusion by the container contents upon pouring. The shapes of the region 4 and of the region 5 of piece 2 fit the minor and major grooves, respectively, of the can lip. Tag piece 2 can be used to peal out the groove filler from the container lip after its use. Alternatively, without a tag piece formed on the strip, by simply allowing an end portion of the strip to extend upward, i.e., not be pressed down into the groove, a means of pulling the strip out of the groove is provided.

The strip 1 might be considered to be a throw-away item after usage, or it might be wiped off and saved for repeated usage. The strip 1 has no extra flange width for pouring. Thus, it bends more easily to fit into the grooves of the container. The portion 5 of the strip 1, which fits into the container groove, can be designed thin enough, and portion 4, thick enough so that the distortions of their thickness upon being bent into an arc would cause them to fit exactly the container grooves.

Figure 4:
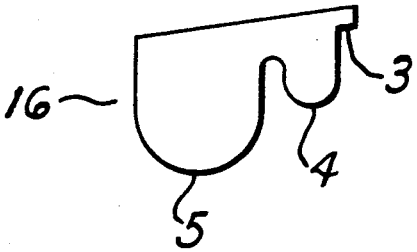
FIG. 4 is the cross section of a piece of material which is formed as an arc shape to match the container lip groove.
Figure 5:
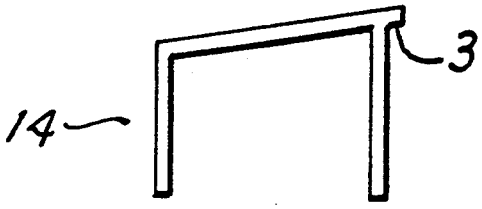
FIG. 5 is the cross section of a piece of material which is formed as an arc and which fits down over the lip of the container.

FIGS. 4 and 5 show cross sections of filler/covers for a container lid seal region. These shapes include pour lips 3. Because of their extra width, including lip or flange 3, these articles might not bend so easily to fit the arc of the groove in the can. They could be cast originally in the required arc to match the container grooves. The piece 16, in FIG. 4, is plugged into the container lip grooves. The portion 4 on piece 16 plugs into the minor groove of the container lip. While portion 4 is not entirely necessary, it provides an ideal fit to the container. In FIG. 5, a piece 14 is shown which would function as a cap over the grooved area of the container lip.

Figure 6:
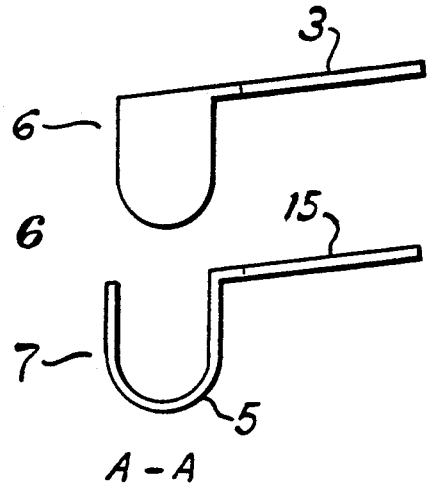
FIG. 6 shows crosssections of articles which are nested within each other and pushed into the container groove.
Figure 7:
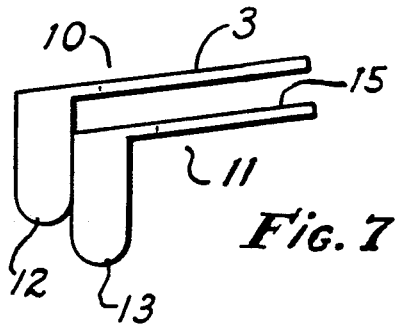
FIG. 7 shows crosssections of articles which are pushed into the container groove side-by-side.
Figure 8:
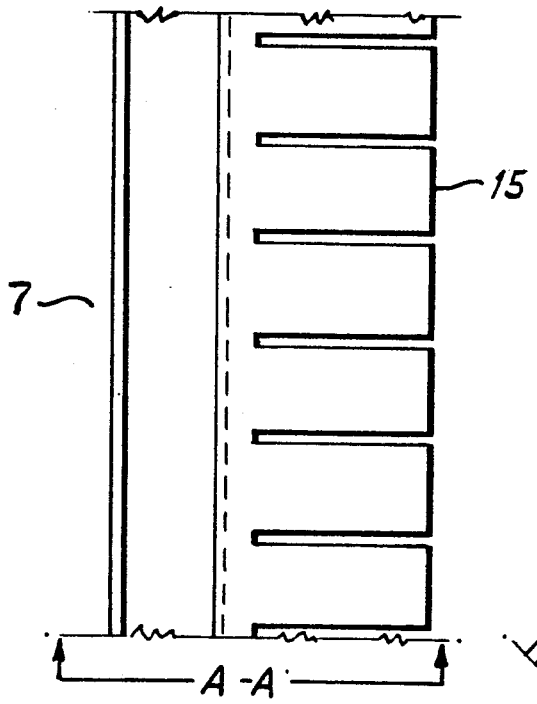
FIG. 8 is a plan view of strip 7 illustrating the teeth in flange 3, and, similar teeth int he flanges of pieces 6, 10, and 11.
Figure 9:
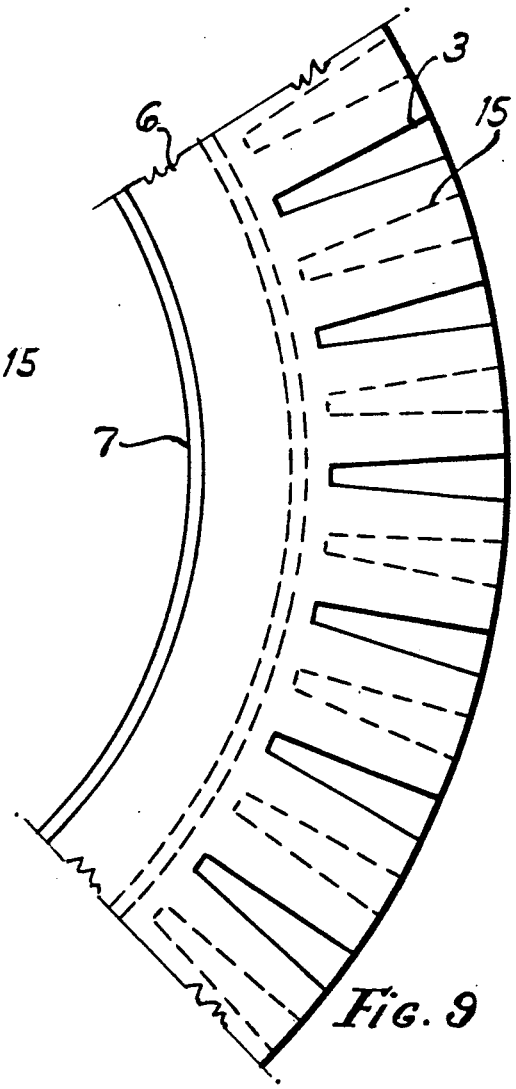
FIG. 9 is a plan view of the articles of FIG. 6 as bent into the arc of the container groove. The overlapping of the teeth of the flanges to form an uninterrupted pouring edge is shown.

FIGS. 6 and 7 both illustrate double strips for installation into the container grooves, the 6 and 7 pair and the 10 and 11 pair. In both cases a pair is pressed together into the container grooves. These designs provide easily-manufactured, continuous strips of material which provide both the groove protection and a pour lip. In FIG. 6, strip 7 fits into the container groove while strip 6 nests into strip 7. In FIG. 7, the portions 12 and 13 of strips 10 and 11 nest side-by-side in the major container well. After the strips are formed by extrusion, the flanges 3 and 5 are stamp cut to form a toothed pattern which allows the bending of the strips into the arc of the container groove. FIG. 8, a plan view of strip 7, shows the teeth formed in the flange 15 to allow the strip 7 (also 6, 10, and 11) to be bent to fit the curvature of the container. FIG. 9 is a plan view of strips 6 and 7 nested together. FIG. 9 shows how such toothed flanges 3 and 15 of strips 6 and 7 overlap to form a continuous pour lip.

I claim:

1. An attachment for a circular lip of an open top cylindrical container having a shaped groove for attachment and sealing with a similarly shaped lid, the attachment comprising:

a cover for the container lip in which contents of the container flow over said cover as the contents are being poured. thus preventing the contents from contaminating he container lip, said cover including, two strips of flexible material comprising, a first strip with a groove depending portion and a second strip with a groove depending portion, said strips are laid together so that their groove depending portions together fit the shaped groove of the container lip and are inserted therein, each said strip having, a horizontally outwardly extending flange with cutouts forming a toothed pattern for each flange, said toothed patterns allowing the length of said strips to be bent into an arc conforming to the arc of the container lip, wherein upon the insertion of the strips within the groove, the flanges are arranged one above the other with the cutouts 180 degrees out of phase, resulting in a continuous pour lip formed by the flanges.

2. An attachment for a circular lip of an open top cylindrical container having a shaped groove for attachment and sealing with a similarly shaped lid, the attachment comprising:

a cover for the container lip in which contents of the container flow over said cover as the contents are being poured, thus preventing the contents from contaminating the container lip, said cover including, two strips of flexible material comprising, a bottom strip being U-shaped in crosssection having a curved bottom contour fitting the shaped groove of the container lip and imbedded therein, and having an inner hollow portion, and a top strip with a flat top, said top strip being of solid shape in crosssection which fills the inner holow portion of the bottom strip when said strips are nested within each other and placed, within the shaped groove, each strip having, a horizontally outwardly extending flange with cutouts forming a toothed pattern for each flange, said toothed patterns allowing the length of said strips to be bent into an arc conforming to the arc of the container lip, wherein upon the nesting of said top and bottom strips, the flanges are arranged one above the other with the cutouts 180 degrees out of phase, resulting in a continuous pour lip formed by the flanges.

* * * * *